US009630065B2

(12) United States Patent
Luo

(10) Patent No.: US 9,630,065 B2
(45) Date of Patent: Apr. 25, 2017

(54) HOLLOW FIBER PIPE STRUCTURE

(71) Applicant: TRI-GREAT INTERNATIONAL LTD., Dongguan (CN)

(72) Inventor: Chunfang Luo, Dongguan (CN)

(73) Assignee: TRI-GREAT INTERNATIONAL LTD., Dongguan, Guangdong (CN)

( * ) Notice: Subject to any disclaimer, the term of this patent is extended or adjusted under 35 U.S.C. 154(b) by 0 days.

(21) Appl. No.: 14/405,769

(22) PCT Filed: Oct. 14, 2013

(86) PCT No.: PCT/CN2013/085172

§ 371 (c)(1),
(2) Date: Dec. 4, 2014

(87) PCT Pub. No.: WO2015/054814

PCT Pub. Date: Apr. 23, 2015

(65) Prior Publication Data

US 2016/0287949 A1 Oct. 6, 2016

(51) Int. Cl.
*F16L 9/00* (2006.01)
*A63B 49/10* (2015.01)

(52) U.S. Cl.
CPC ..... *A63B 49/10* (2013.01); *A63B 2209/00* (2013.01); *A63B 2209/02* (2013.01)

(58) Field of Classification Search
CPC . F16L 9/14; F16L 11/112; F16L 11/08; A63B 2209/02; Y10T 428/1366; Y10T 428/1372
USPC ..... 138/172–174; 473/524, 535, 547
See application file for complete search history.

(56) References Cited

U.S. PATENT DOCUMENTS

| | | | | |
|---|---|---|---|---|
| 4,025,675 | A * | 5/1977 | Jonda | E04C 2/36 138/148 |
| 6,012,996 | A * | 1/2000 | Lo | A63B 49/10 473/535 |
| 6,592,475 | B2 * | 7/2003 | Poggi | A63B 49/02 473/524 |
| 2002/0052256 | A1 * | 5/2002 | Poggi | A63B 49/02 473/546 |
| 2014/0239531 | A1 * | 8/2014 | Jiansheng | B29C 44/16 264/46.4 |

* cited by examiner

*Primary Examiner* — Patrick F Brinson
(74) *Attorney, Agent, or Firm* — Leong C. Lei

(57) ABSTRACT

A hollow fiber pipe structure includes a fiber pipe body. The fiber pipe body is hollow and formed with a through hole. The inner wall of the through hole is integrally formed with a plurality of reinforcement ribs. Each of the reinforcement ribs includes a foam material layer therein. The inner wall of the through hole is integrally formed with a plurality of reinforcement ribs to enhance the strength of the present invention greatly, and each reinforcement rib comprises a foam material layer therein so that the fiber pipe body is more compact by compressing the foam material layer. The present invention not only enhances its whole strength but also saves the use of the fiber fabric so as to lower the manufacture cost. Besides, the product is light. This is beneficial for hitting a ball.

4 Claims, 5 Drawing Sheets

HOLLOW FIBER PIPE STRUCTURE

BACKGROUND OF THE INVENTION

1. Field of the Invention

The present invention relates to a pipe structure, and more particularly to a hollow fiber pipe structure for sporting apparatuses.

2. Description of the Prior Art

A hollow fiber pipe is one of the main materials for manufacturing a racket. The fiber pipe comprises a hollow pipe body, so that the racket is light for use and the user can bring the skills into full play.

So far, the thickness of the wall of the hollow fiber pipe is even, without change. When in use, the racket made of the hollow fiber pipe has many shortcomings, for example, the vibration is great, which is not beneficial for the user to control the racket; the racket is heavy, which is not convenient for the user to control the racket, and the user is tired easily; the structural strength is not enough so the racket may be bent or damaged with ease to influence the service life of the racket.

Accordingly, the inventor of the present invention has devoted himself based on his many years of practical experiences to solve these problems.

SUMMARY OF THE INVENTION

The primary object of the present invention is to provide a hollow fiber pipe structure to overcome the shortcomings of the prior art which is heavy and low strength and high cost.

In order to achieve the aforesaid object, the hollow fiber pipe structure of the present invention comprises a fiber pipe body. The fiber pipe body is hollow and formed with a through hole. The inner wall of the through hole is integrally formed with a plurality of reinforcement ribs. Each of the reinforcement ribs comprises a foam material layer therein.

Preferably, the reinforcement ribs comprise a plurality of first reinforcement ribs and a plurality of second reinforcement ribs. Each of the first reinforcement ribs extends axially from one end of the through hole toward the middle portion of the fiber pipe body. Each of the second reinforcement ribs extends axially from another end of the through hole toward the middle portion of the fiber pipe body.

Preferably, the plurality of first reinforcement ribs and the plurality of second reinforcement ribs are not aligned with each other.

Preferably, the plurality of first reinforcement ribs and the plurality of second reinforcement ribs are interlaced with each other.

Preferably, the first reinforcement ribs and the second reinforcement ribs each have a height decreased from an outer end toward an inner end thereof.

Compared to the prior art, the present invention has obvious advantages and effects. The inner wall of the through hole is integrally formed with a plurality of reinforcement ribs to enhance the strength of the present invention greatly, and each reinforcement rib comprises a foam material layer therein so that the fiber pipe body is more compact by compressing the foam material layer. The present invention not only enhances its whole strength but also saves the use of the fiber fabric so as to lower the manufacture cost. Besides, the product is light. This is beneficial for hitting a ball.

DETAILED DESCRIPTION OF THE PREFERRED EMBODIMENTS

Embodiments of the present invention will now be described, by way of example only, with reference to the accompanying drawings.

Figure 1:
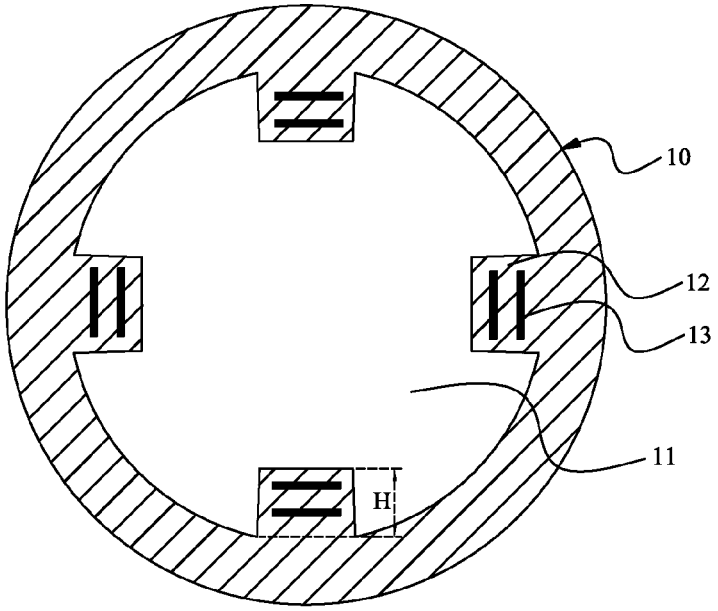
FIG. 1 is a radial sectional view according to a first embodiment of the present invention.
Figure 2:
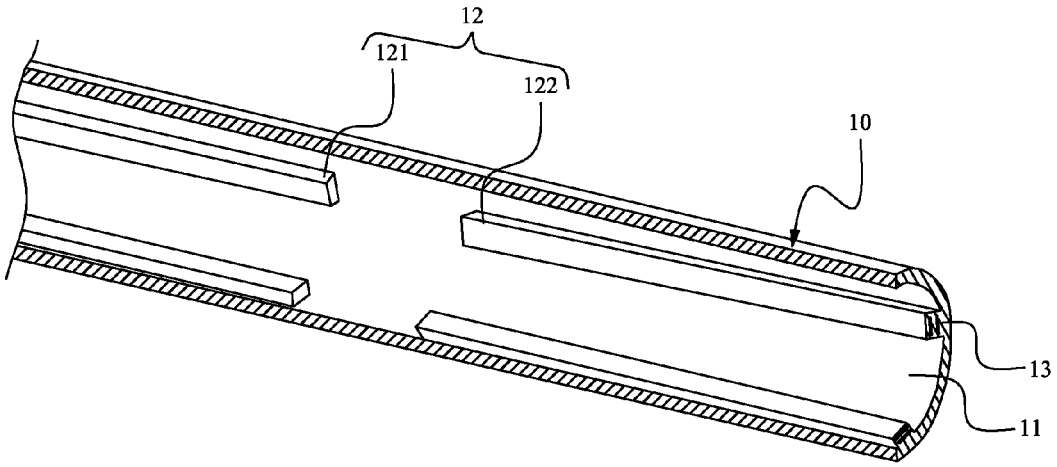
FIG. 2 is a partial sectional view according to the first embodiment of the present invention.

As shown in FIG. 1 and FIG. 2, a first embodiment of the present invention comprises a fiber pipe body 10.

The fiber pipe body 10 is hollow and formed with a through hole 11. The inner wall of the through hole 11 is integrally formed with a plurality of reinforcement ribs 12.

Each of the reinforcement ribs 12 comprises a foam material layer 13 therein. The foam material layer 13 is formed by foaming and solidifying a powdered or granular foam material. In this embodiment, the reinforcement ribs 12 comprise a plurality of first reinforcement ribs 121 and a plurality of second reinforcement ribs 122. Each of the first reinforcement ribs 121 extends axially from one end of the through hole 11 toward the middle portion of the fiber pipe body 10. Each of the second reinforcement ribs 122 extends axially from another end of the through hole 11 toward the middle portion of the fiber pipe body 10. The plurality of first reinforcement ribs 121 and the plurality of second reinforcement ribs 122 are aligned with each other. The heights H of the plurality of first reinforcement ribs 121 and the plurality of second reinforcement ribs 122 are uniform and equal.

To manufacture the present invention, a mold core having grooves on its surface thereof is provided. The surface of the mold core is wound with a fiber fabric, and the surface of the fiber fabric facing the grooves is provided with a foam material. After winding the fiber fabric, the mold core is placed in the mold to be solidified. After solidifying, the mold core is drawn out from the mold to complete the present invention.

Figure 3:
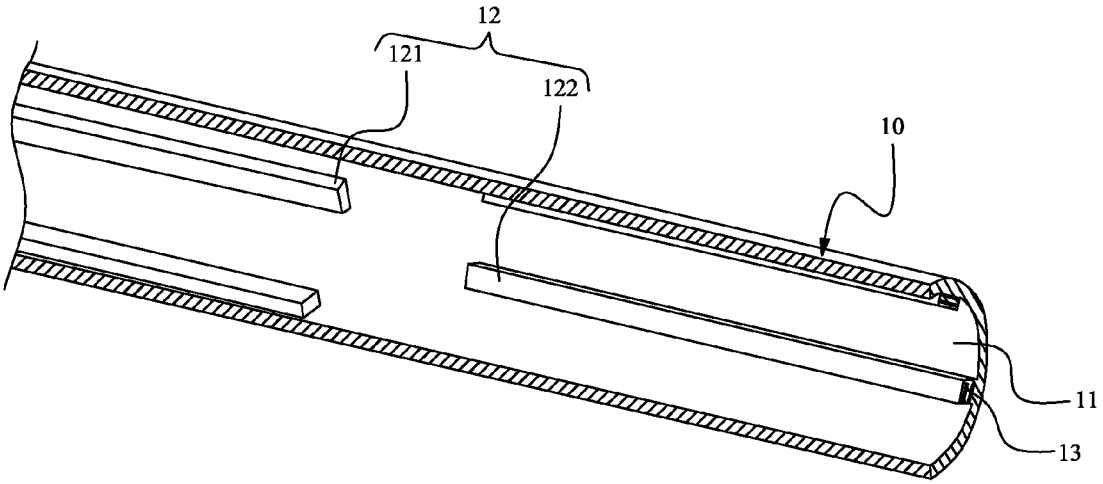
FIG. 3 is a partial sectional view according to a second embodiment of the present invention.

FIG. 3 shows a second embodiment of the present invention, which is substantially similar to the first embodiment with the exceptions described hereinafter. In this embodiment, the plurality of first reinforcement ribs 121 and the plurality of second reinforcement ribs 122 are not aligned with each other, such that the structural strength of the present invention is more even.

The manufacture process of the second embodiment is substantially similar to that of the first embodiment. The difference is that the second embodiment uses two butt mold cores. After the fiber fabric is solidified, the two butt mold cores are respectively pulled out.

Figure 4:
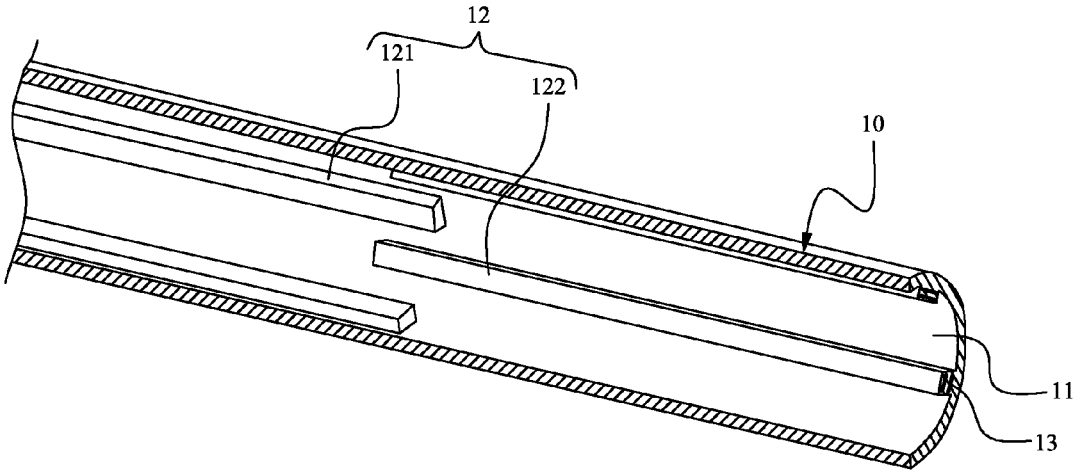
FIG. 4 is a partial sectional view according to a third embodiment of the present invention.

FIG. 4 shows a third embodiment of the present invention, which is substantially similar to the first embodiment with the exceptions described hereinafter. In this embodiment, the plurality of first reinforcement ribs 121 and the plurality of second reinforcement ribs 122 are interlaced with each other, such that the structural strength of the present invention is more even and the whole strength is larger.

The manufacture process of the third embodiment is substantially similar to that of the second embodiment, and won't be described in detail.

Figure 5:
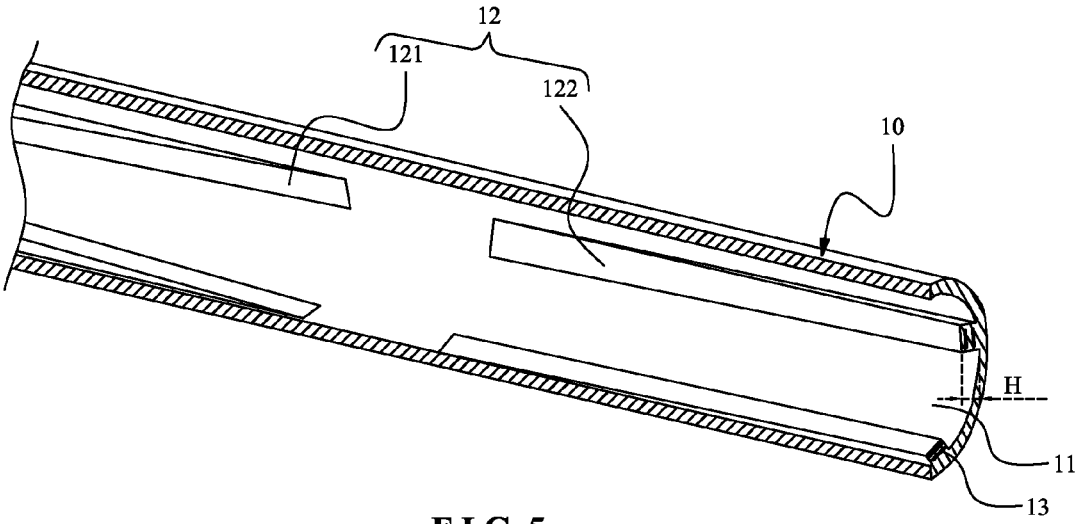
FIG. 5 is a partial sectional view according to a fourth embodiment of the present invention.

FIG. 5 shows a fourth embodiment of the present invention, which is substantially similar to the first embodiment with the exceptions described hereinafter. In this embodiment, the height H of each first reinforcement rib 121 and the height H of each second reinforcement rib 122 are gradually decreased from the outer end toward the inner end, such that the structural strength of the two ends of the present invention is better and the material can be saved.

The manufacture process of the fourth embodiment is substantially similar to that of the second embodiment, and won't be described in detail.

The features of the present invention are that the inner wall of the through hole is integrally formed with a plurality of reinforcement ribs to enhance the strength of the present invention greatly and that each reinforcement rib comprises a foam material layer therein so that the fiber pipe body is more compact by compressing the foam material layer. The present invention not only enhances its whole strength but also saves the use of the fiber fabric so as to lower the manufacture cost. Besides, the product is light. This is beneficial for hitting a ball.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A hollow fiber pipe structure, comprising a fiber pipe body, the fiber pipe body being hollow and formed with a through hole, an inner wall of the through hole being integrally formed with a plurality of reinforcement ribs, each of the reinforcement ribs comprising a foam material layer therein; wherein the reinforcement ribs comprise a plurality of first reinforcement ribs and a plurality of second reinforcement ribs, each of the first reinforcement ribs extending axially from one end of the through hole toward a middle portion of the fiber pipe body, each of the second reinforcement ribs extending axially from another end of the through hole toward the middle portion of the fiber pipe body.

2. The hollow fiber pipe structure as claimed in claim 1, wherein the plurality of first reinforcement ribs and the plurality of second reinforcement ribs are not aligned with each other.

3. The hollow fiber pipe structure as claimed in claim 1, wherein the plurality of first reinforcement ribs and the plurality of second reinforcement ribs are interlaced with each other.

4. The hollow fiber pipe structure as claimed in claim 1, wherein the first reinforcement ribs and the second reinforcement ribs each have a height decreased from an outer end thereof toward an inner end thereof.

* * * * *